US006105514A

United States Patent [19]

Liu

[11] Patent Number: 6,105,514

[45] Date of Patent: Aug. 22, 2000

[54] WATER-COOLED CREMATING PLATFORM

[76] Inventor: Kuei-Lung Liu, No. 4, Lane 429, Cheng Ching Road, Kaohsiung, Taiwan

[21] Appl. No.: 09/282,203

[22] Filed: Mar. 31, 1999

[51] Int. Cl.[7] ..... F23G 1/00

[52] U.S. Cl. ..... 110/194; 110/212; 110/233

[58] Field of Search ..... 110/194, 235, 110/233, 234, 212; 165/170, 168, 171; 126/273 R, 21 R

[56] References Cited

U.S. PATENT DOCUMENTS

| | | | |
|---|---|---|---|
| 1,972,073 | 9/1934 | Bleitz | 110/194 |
| 5,638,897 | 6/1997 | Hirano et al. | 165/170 |
| 5,826,646 | 10/1998 | Bae et al. | 165/170 |

FOREIGN PATENT DOCUMENTS

| | | | |
|---|---|---|---|
| 56516 | 5/1981 | Japan | 110/194 |
| 1341043 | 12/1991 | United Kingdom | 110/194 |

*Primary Examiner*—James C. Yeung

[57] ABSTRACT

A water-cooled cremating platform for use in a cremating stove includes a metallic upper plate, a metallic main body and a metallic side plate. The upper plate is removably positioned on an open upper side of the main body for holding a dead body to be cremated. The main body has several guide plates spaced apart to form a water route for a flow of cooling water. The side plate is affixed to the main body, and has an air exit, an overflow outlet, a water inlet and a water outlet in open communication with the water route. Radiating chips are provided, extending from bottom of the upper plate into the water route such that the upper plate can be cooled down very rapidly after cremation before the next step of collecting of ashes, to be started without a substantial delay.

6 Claims, 6 Drawing Sheets

WATER-COOLED CREMATING PLATFORM

BACKGROUND OF THE INVENTION

With growing population and decreasing available land on the Earth, cremation has become an important burial issue.

A known device for cremating dead bodies shown in FIGS. 5 and 6, which is used in crematories, comprises a stove 10 and a platform 20 as main parts.

The stove 10 includes a burning machine 30 on one side, and an upper door 101 and a lower door 102 on another side of the stove 10.

The platform 20 includes a movable support member 201 and a burning support 202. The burning support 202 is made of firebrick, and can hold a coffin with a dead body therein.

For cremation, the coffin is placed on the burning support 202, and then the whole platform 20 is moved into the stove 10. The burning machine burns the coffin and the body therein with flames of high temperature. When the cremation is finished, the doors 101 and 102 are opened, and the platform 20 is moved out of the stove 10 for further steps associated with the cremation procedure, including collection of ashes from the burning support 202.

Disadvantageously, the burning support 202, being made of firebrick, radiates heat very slowly. Specifically, it takes about one hour to cool down the temperature of the firebrick from 1000° C. to 50° C. Thus, it takes at least one hour of delay before the next step, i.e., collecting the ashes, can be commenced.

It is, therefore, clear that only two or three dead bodies a day can be cremated by means of the conventional cremating device. Such a low efficiency is not satisfactory for operation of a crematory.

Another drawback is that the firebrick is likely to break being exposed to high temperature for a long time.

SUMMARY OF THE INVENTION

It is, therefore, a main object of the present invention to provide a water-cooled cremating platform, which can cool down relatively quickly after the cremation.

It is also an object of the present invention to provide a cremating platform, which is mainly made of metal, such that it can radiate heat faster and is less likely to be damaged under the influence of high temperature.

According to the teaching of the present invention, a water-cooled cremating platform is used in the cremating stove and is provided with wheels such that it can be moved easily. The platform includes a main body, an upper plate and a side plate.

The main body has several guide plates spaced apart such that a water route is formed therebetween. The main body has an open upper side, and an opening in one of the walls in open communication with the water route.

The upper plate is provided for holding a dead body, and is removably positioned on the upper open side of the main body. The upper plate has radiating chips extending from a bottom thereof into the water route, for radiating heat.

The side plate is affixed to the main body at an opening in the main body, and has an air exit, a water inlet, a water outlet and an overflow outlet. During the cremation, water is supplied into the main body through the water inlet. The water flows along the water route and exits from the main body through the over flow outlet, thereby keeping the platform at a relatively low temperature (about 100° C.).

After the cremation, the water outlet is opened for permitting water to flow along the water route faster to cool down the upper plate rapidly such that the next step, collecting of ashes, can be started without delay.

BRIEF DESCRIPTION OF THE DRAWINGS

The present invention will be better understood with reference to the accompanying drawings, wherein.

DETAILED DESCRIPTION OF THE PREFERRED EMBODIMENT

Figure 1:
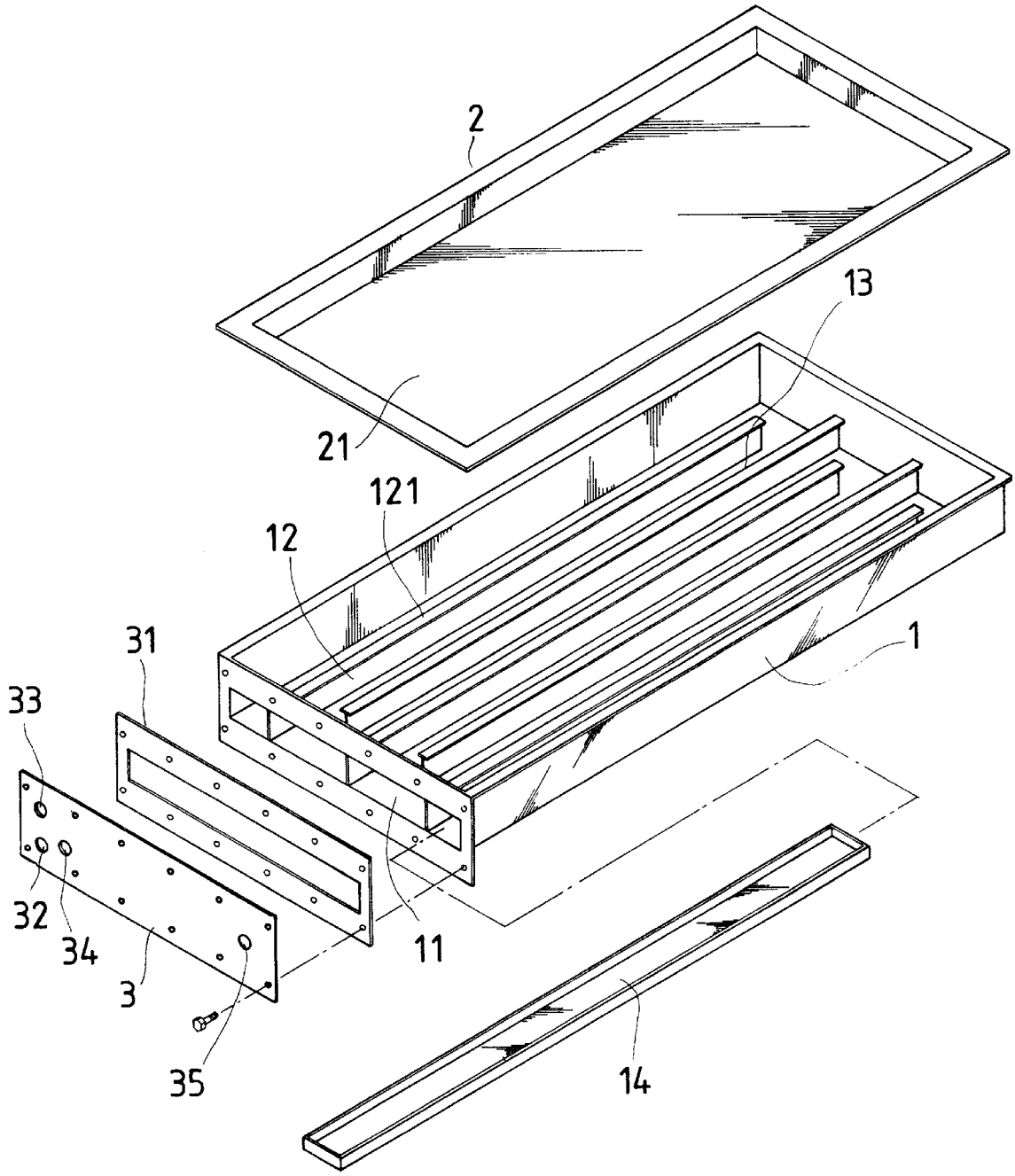
FIG. 1 is an exploded perspective view of a water-cooled cremating platform according to the present invention.
Figure 2:
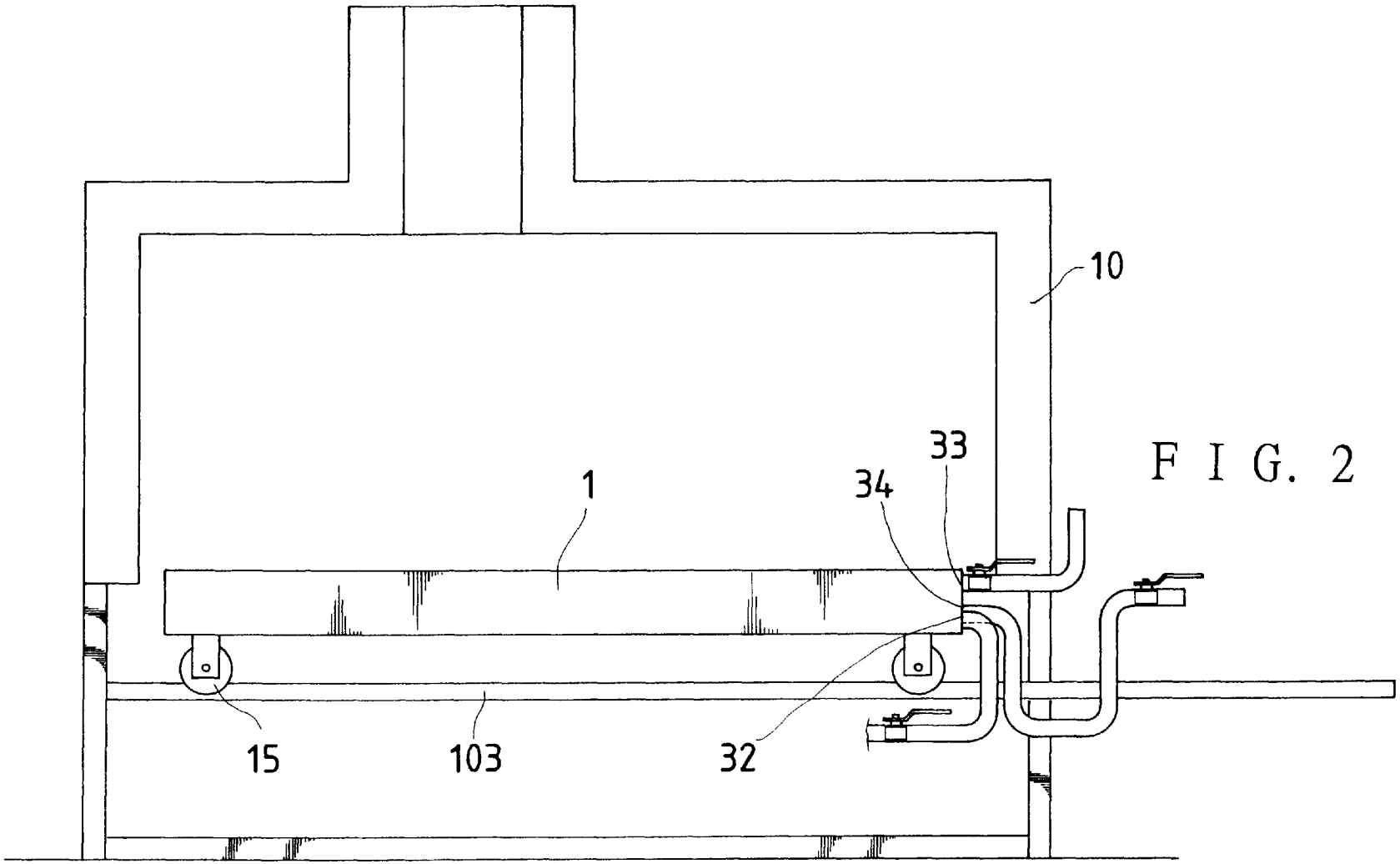
FIG. 2 is a side elevation view of the water-cooled cremating platform of FIG. 1.
Figure 3:
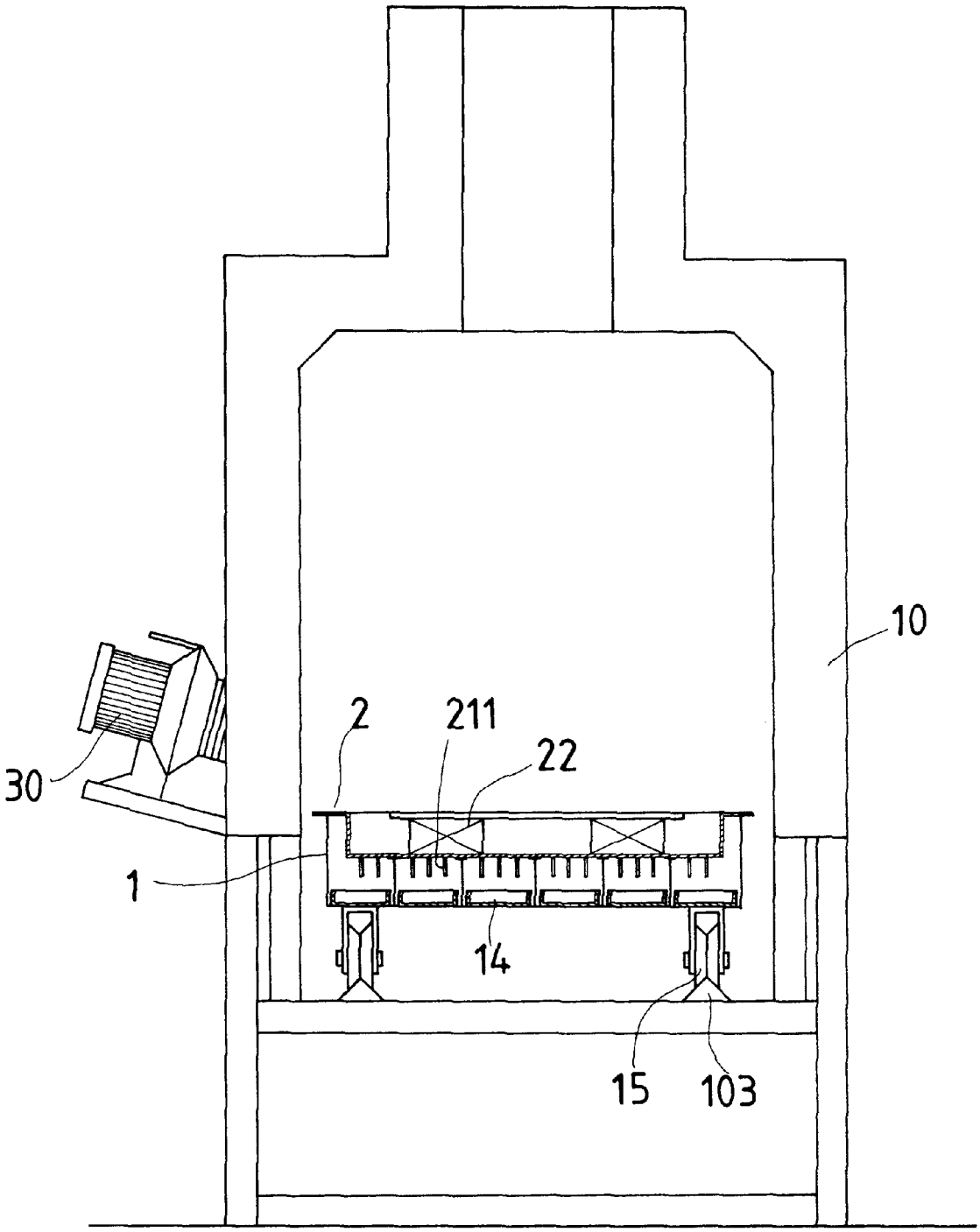
FIG. 3 is a cross-sectional view of the water-cooled cremating platform of FIG. 1.

Referring to FIGS. 1, 2, and 3, a cremating platform of the present invention comprises a metallic main body 1, a metallic upper plate 2, and a metallic side plate 3.

The main body 1 has an open upper side (not numbered), an opening 11 and a plurality of guide plates 12, and is provided with wheels 15 on a bottom thereof in order to be movable. The guide plates 12 are spaced apart inside the main body 1 such that a water-cooling route 13 is formed therebetween. U-shaped elongated shallow holding plates 14 are placed between the wall of the main body 1 and the guide plates 12 adjacent to the wall, and between every two adjacent guide plates 12 inside the main body 1.

The side plate 3 is fixedly connected to the opening 11 of the main body 1 with a gasket 31 located therebetween. The gasket 31 serves to prevent water from leaking through joints between the main body 1 and the side plate 3.

The side plate 3 is provided with a water outlet 32, an air exit 33, a water inlet 35 and an overflow outlet 34. The overflow outlet 34 is located at a level higher than, and close to, the water outlet 32.

Each of the guide plates 12 further has a contacting portion 121 on an upper end portion thereof such that the bottom of the upper plate 2 can be stably supported thereon.

The upper plate 2 has a holding recess 21. A plurality of support members 22, as shown in FIG. 3, are positioned within the holding recess 21 for supporting a coffin. The upper plate further has many radiating chips 211 on the bottom thereof, as shown in FIG. 3. The radiating chips 211 extend into the water route 13 of the main body 1 when the upper plate 2 is positioned on the main body 1.

Similar to the prior art cremating device, the cremating platform of the present invention is used in a stove 10 which has a burning machine 30 and rails 103. The rails 103 permit the wheels 15 of the cremating platform to move therealong in moving the platform into, or out of, the stove 10. The burning machine 30 provides fire to burn the coffin positioned in the stove 10 on the platform.

The U-shaped elongated holding plates 14 are provided for holding dirt and sand that sink thereinto while the water-cooled platform is used. The U-shaped plates 14 can be taken out of the main body 1 for cleaning after a certain period of time of use.

Each of the water outlet 32, the air exit 33, the overflow outlet 34 and the water inlet 35 has a respective valve and is connected to a respective pipe, as best shown in FIG. 2.

In use, the platform is moved into the stove 10 with the coffin thereon. Then, the valve of the overflow outlet 34 is adjusted according to the predetermined water level inside the main body 1. Water is supplied into the main body 1 through the water inlet 35. The water then flows along the water-cooling route 13, and finally flows out through the overflow outlet 34. The burning machine 30 is started to burn the coffin inside the stove 10, with water circulating as described above. Thus, the temperature inside the main body 1 is kept relatively low (about 100° C.) during the cremation period. At the same time, steam from the heated water can exit from the air exit 33.

Figure 4:
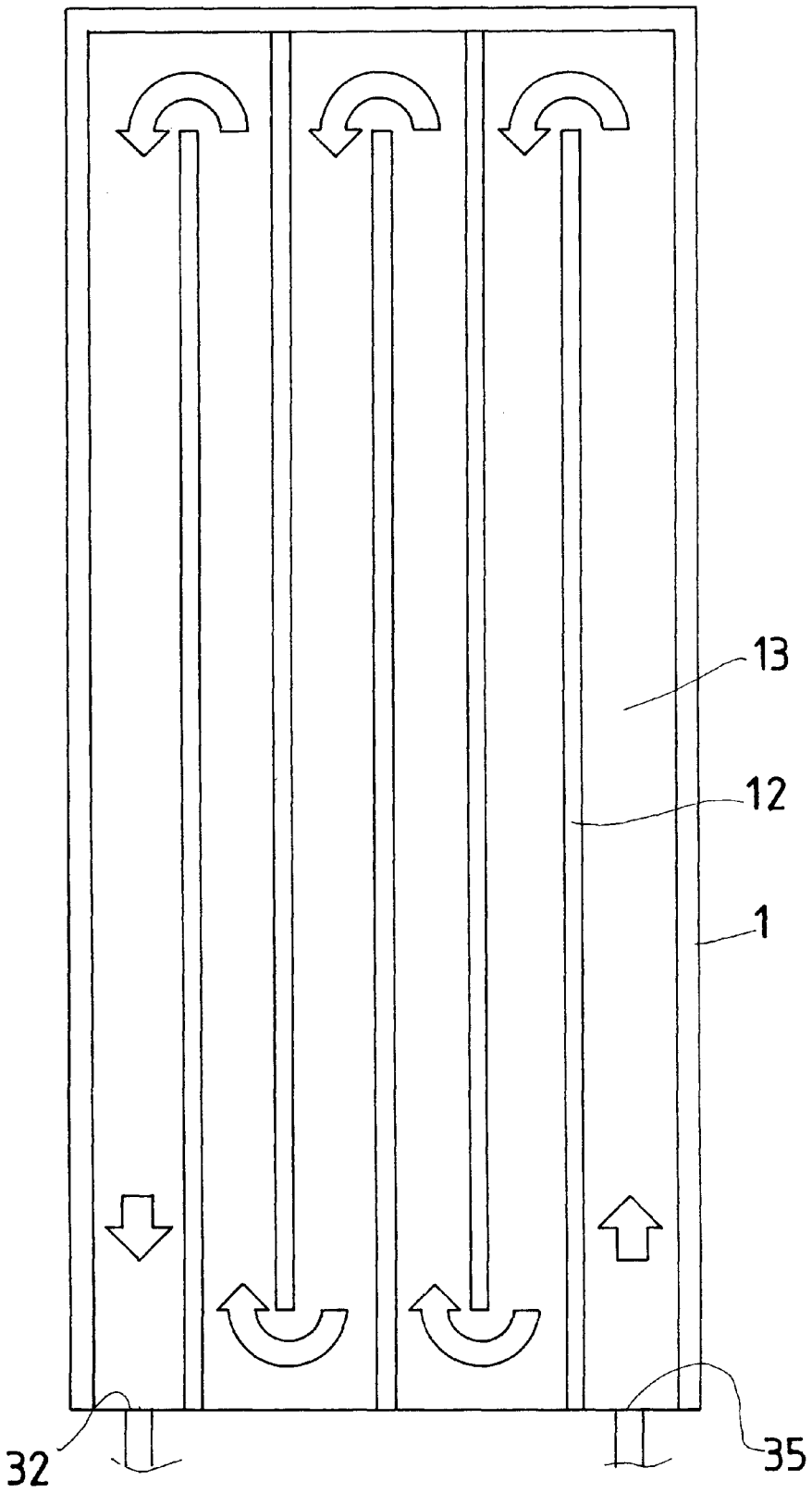
FIG. 4 is a top view of the water-cooled cremating platform of FIG. 1, showing flow of water along the water-cooling route.
Figure 5:
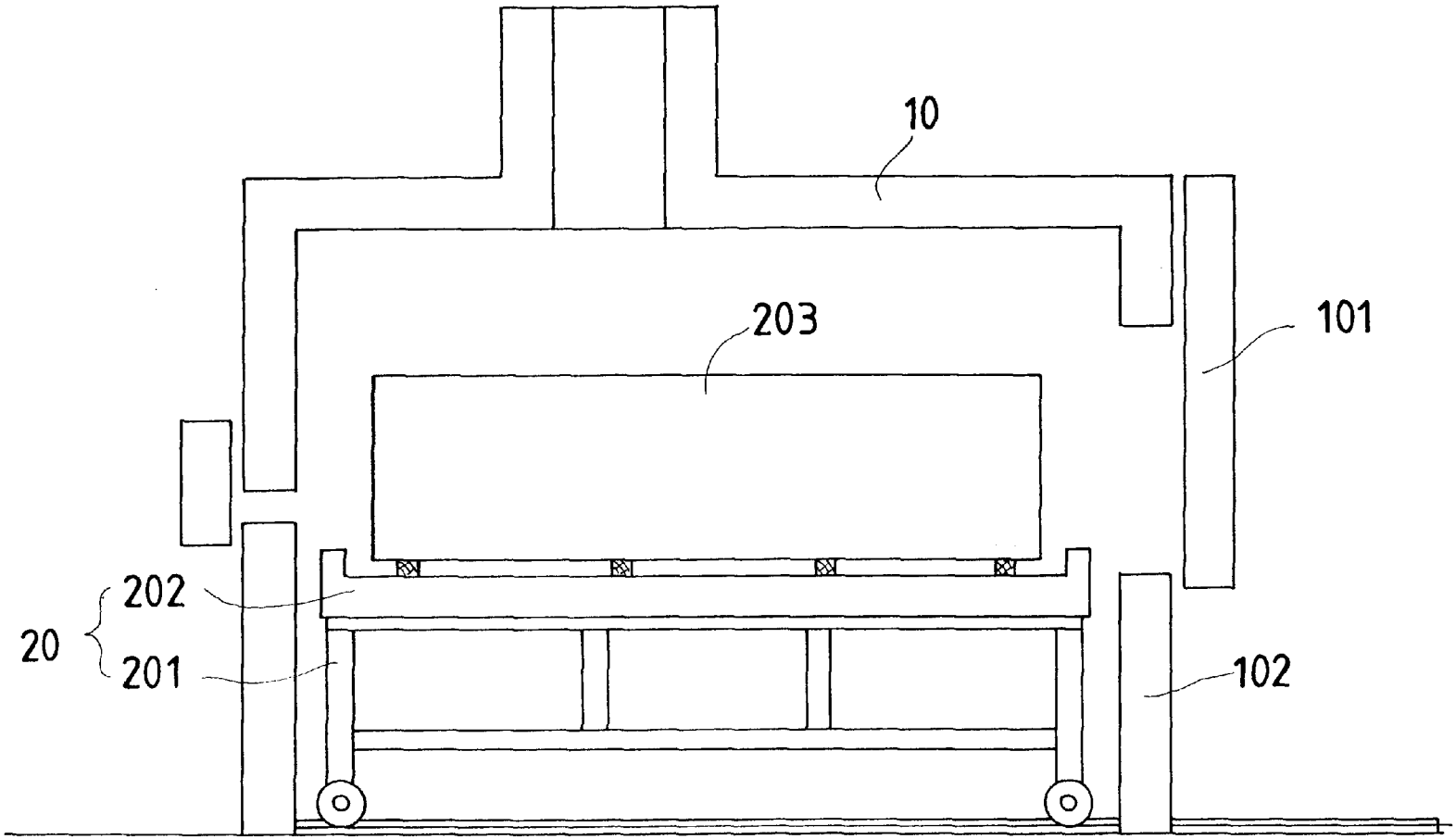
FIG. 5 (PRIOR ART)
FIG. 5 is a side elevation view of a conventional cremating platform.
Figure 6:
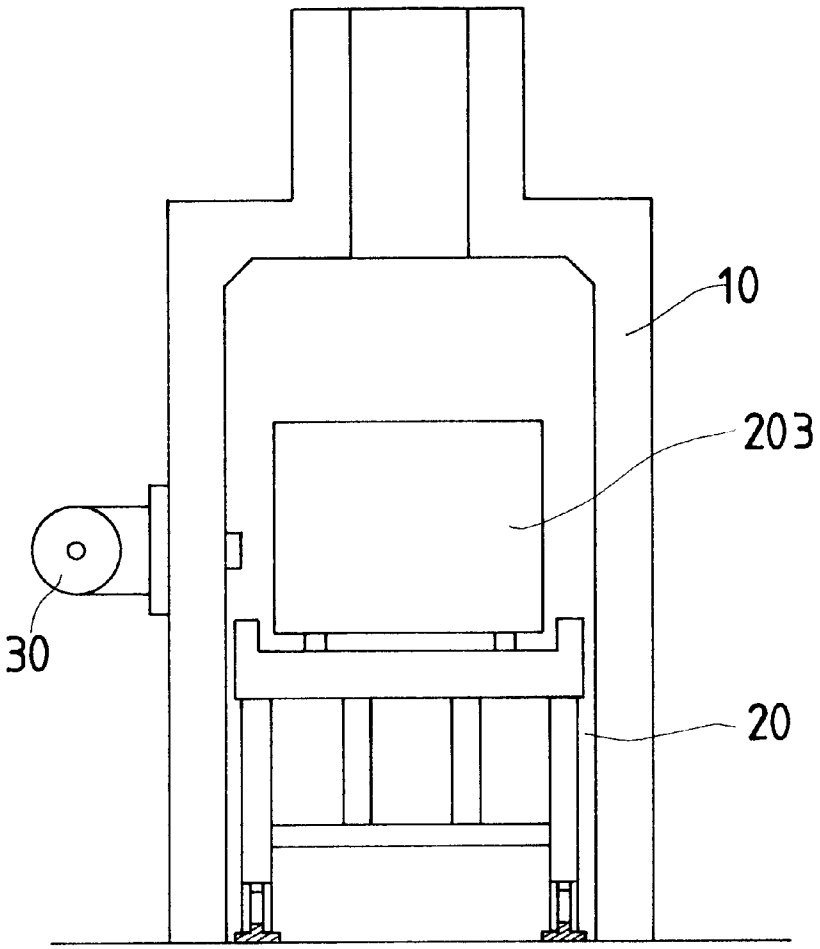
FIG. 6 (PRIOR ART)
FIG. 6 is a front elevation of the conventional cremating platform of FIG. 5.

After the burning is finished, the burning machine 30 is turned off. The valve of the water outlet 32 is opened such that water can flow in larger volume and faster along the route 13, and finally flow out from the outlet 32, as shown in FIG. 4. Thus, the temperature of the upper plate 2 can be reduced relatively fast by means of the radiating chips 211 and the stream of water.

According to an experiment, in the platform of the present invention, it takes about only one minute for the temperature to be reduced from 1000° C. to 50° C.

When the temperature is reduced to about 50° C., the valves of the water inlet 35 and the water outlet 32 are closed for the next step, i.e., collecting the ashes.

From the above description, it can be easily understood that the water-cooled cremating platform of the present invention has desirable features as follows:

1. After cremation, the upper plate 2 can be cooled down relatively fast by means of the radiating chips 211 and the fast-flowing cooling water. Consequently, the delay between cremation steps is greatly shortened, and the efficiency of crematories is greatly increased.

2. Being made of metal, the main body, the upper plate, and the side plate cannot be easily damaged or deformed during the high temperature cremation process. So, the service life thereof is relatively long.

3. As the water-cooled cremating platform has relatively high efficiency, it solves the problem associated with building a larger number of crematories.

I claim:

1. A water-cooled cremating platform for a cremating stove, comprising:

(a) a main body, said main body being formed by a pair of longitudinally spaced apart first walls, a pair of spaced apart second walls extending between said first walls, and a bottom wall coupled to said first and second walls, said first and second walls defining an interior portion of said main body therebetween and further forming an open upper side of said main body, one of said first walls of said main body having at least one opening formed therein;

(b) a plurality of guide plates disposed within said interior portion of said main body and extending longitudinally in spaced parallel relationship, said plurality of guide plates each having a length dimension less than said longitudinal spacing of said first walls, said plurality of guide plates being alternatingly coupled to an opposing one of said first walls for forming respective water channels therebetween to define a water route;

(c) an upper plate removably positioned on said open upper side of said main body, said upper plate having a holding recess formed therein;

(d) a plurality of radiating chips extending downwardly from a bottom surface of said upper plate into said water route within said main body; and (e) a side plate removably attached to said one of said first walls having said at least one opening formed therein, said side plate having a water inlet, a water outlet, an air exit and an overflow outlet formed therein, said air exit being positioned at a level higher than that of said water outlet, wherein water being supplied to said cremating platform through said water inlet flows through said water route within said main body and exits therefrom through said water outlet and said overflow outlet, thereby cooling said cremating platform.

2. The water-cooled cremating platform as claimed in claim 1, further including a plurality of U-shape elongated shallow holding plates, each holding plate being positioned within a respective one of said water channels of said water route inside said main body for holding unwanted particles and dirt sinking thereinto during use of said platform.

3. The water-cooled cremating platform as claimed in claim 1, wherein each of said guide plates has a contacting portion on an upper end portion thereof for holding said upper plate thereon.

4. The water-cooled cremating platform as claimed in claim 1, wherein said overflow outlet of said side plate is positioned at a higher level than said water outlet.

5. The water-cooled cremating platform as claimed in claim 1, wherein said main body, said upper plate and said side plate are made of metal.

6. The water-cooled cremating platform as claimed in claim 1, wherein said overflow outlet, said water outlet and said water inlet are respectively connected to a pipe and valve.

* * * * *